US010883753B2

(12) United States Patent
Alsadah et al.

(10) Patent No.: US 10,883,753 B2
(45) Date of Patent: Jan. 5, 2021

(54) RADIANT COOLING APPARATUS AND SYSTEM

(71) Applicant: KING FAHD UNIVERSITY OF PETROLEUM AND MINERALS, Dhahran (SA)

(72) Inventors: Jihad Hassan Alsadah, Safwa (SA); Esmail Mohamed Ali Mokheimer, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 612 days.

(21) Appl. No.: 15/141,990

(22) Filed: Apr. 29, 2016

(65) Prior Publication Data

US 2017/0314837 A1 Nov. 2, 2017

(51) Int. Cl.

| | |
|---|---|
| ***F25D 11/00*** | (2006.01) |
| ***F28F 13/18*** | (2006.01) |
| ***F25B 39/02*** | (2006.01) |
| ***F25B 49/02*** | (2006.01) |

(Continued)

(52) U.S. Cl.

CPC ..... *F25D 11/00* (2013.01); *F24F 5/0092* (2013.01); *F25B 39/02* (2013.01); *F25B 49/022* (2013.01); *F28F 13/18* (2013.01); *F24F 2110/10* (2018.01); *F25B 2700/21171* (2013.01); *F28F 2245/06* (2013.01)

(58) Field of Classification Search

CPC ..... F25D 11/00; F25B 39/00; F25B 39/02; F28F 13/18; F28F 13/00

See application file for complete search history.

(56) References Cited

U.S. PATENT DOCUMENTS

| | | | | |
|---|---|---|---|---|
| 5,228,500 A | | 7/1993 | Sano | |
| 5,729,994 A | * | 3/1998 | Mukaiyama | F24F 5/0092 62/186 |
| 5,996,354 A | | 12/1999 | Sokolean et al. | |

(Continued)

FOREIGN PATENT DOCUMENTS

| | | | |
|---|---|---|---|
| CH | 585882 A | * | 3/1977 |
| JP | 10089727 A | * | 4/1998 |

OTHER PUBLICATIONS

"Periodic table." Wikipedia, The Free Encyclopedia. Wikipedia, The Free Encyclopedia, Aug. 7, 2018. Web. Aug. 15, 2018.*

(Continued)

*Primary Examiner* — Edward F Landrum
*Assistant Examiner* — Melodee Jefferson
(74) *Attorney, Agent, or Firm* — Oblon, McClelland, Maier & Neustadt, L.L.P.

(57) ABSTRACT

A radiant cooling system comprises an enclosure, a cooling element and a cooling device. The enclosure includes a first wall that is transmissive of infrared radiation. The cooling element is disposed in the enclosure. The cooling device is coupled to the cooling element. The cooling element provides cooling mainly by radiative exchange. The system promotes cooling by radiative exchange and significantly reduces condensation problems and is compatible with open and enclosed spaces. Thermal losses of cooling power to conductive and convective pathways are significantly reduced. The system comes in a variety of forms including flat, cylindrical and dome-like geometries.

14 Claims, 4 Drawing Sheets

(51) Int. Cl.
*F24F 5/00* (2006.01)
*F24F 110/10* (2018.01)

(56) References Cited

U.S. PATENT DOCUMENTS 8,844,608 B2 9/2014 Kimura et al.
2003/0209539 A1* 11/2003 Dalton ..... B01D 53/32 219/634
2005/0032257 A1* 2/2005 Camras ..... H01L 33/405 438/25
2005/0243539 A1* 11/2005 Evans ..... H01L 33/648 362/84
2011/0175520 A1* 7/2011 Ramer ..... F21K 9/232 313/501
2014/0116420 A1* 5/2014 Lefay ..... F24S 10/753 126/634
2015/0124244 A1* 5/2015 Earl ..... G01J 5/0862 356/43
2015/0375299 A1* 12/2015 Ownby ..... B22D 30/00 164/61
2015/0377389 A1* 12/2015 Blondel ..... F16L 11/085 62/324.6
2016/0054078 A1* 2/2016 Hattori ..... F21V 29/89 362/373
2017/0248381 A1* 8/2017 Yang ..... F28F 13/18

OTHER PUBLICATIONS

"Polytetrafluoroethylene." Wikipedia, The Free Encyclopedia. Wikipedia, The Free Encyclopedia. Aug. 15, 2018. Web. Aug. 15, 2018.*
English Translation of Okamura JP10089727 (Year: 2019).*
English Translation of Tsuchdin CH585882 (Year: 2019).*
Wikipedia contributors. "Atmosphere of Earth." Wikipedia, The Free Encyclopedia. Wikipedia, The Free Encyclopedia, Mar. 2, 2019. Web. Mar. 2, 2019 (Year: 2019).*
Wikipedia contributors. "Emissivity." Wikipedia, The Free Encyclopedia. Wikipedia, The Free Encyclopedia, Sep. 3, 2019. Web. Sep. 3, 2019 (Year: 2019).*
https://www.pcbcart.com/pcb-capability/pcb-materials.html (Year: 2019).*
"Radiant chilled ceiling", Alpety Schako Klima-Luft Ferdinand Schad KG, http://www.archiexpo.com/prod/schako-klima-luft-ferdinand-schad-kg/radiant-chilled-ceilings-65977-347070.html, May 12, 2015, 28 pages.
"Ceiling Cooling System", Alpety Schako Klima-Luft Ferdinand Schad KG, 2009, 16 pages.

* cited by examiner

RADIANT COOLING APPARATUS AND SYSTEM

FIELD OF THE INVENTION

This disclosure relates to radiant cooling systems.

BACKGROUND OF THE INVENTION

One of the conveniences of the developed world is buildings with Heating Ventilation and Air Conditioning (HVAC) systems. Centralized HVAC systems include a heating and cooling system located at one central location within or proximate a building and duct work which distributes heated or cooled air to different parts of the building. Radiant systems include individual heat exchangers located in rooms of a building. Contrary to what their name might imply, the radiators used in radiant systems do not exclusively transfer heat via radiation. Rather, they transfer heat by conduction and more significantly by convection.

While radiant heating is more common, there have been some attempts to develop radiant cooling. One limitation of radiant cooling systems is that the cooling radiators can cause condensation which can lead to mold and mildew if the surface temperature is below the dew point. The dew point is an increasing function of the relative humidity so the problem of condensation presents a greater challenge in humid climates. The temperature of the radiator can be set above the dew point in order to avoid condensation. However, taking the dew point as a lower limit on the radiator temperature restricts the cooling power of a radiator of a given size. Thus, in order to achieve sufficient cooling power without violating the lower limit imposed by the dew point, the size of the cooling radiator is increased but increasing the size of the cooling radiator makes it obtrusive and increases its cost.

SUMMARY OF THE INVENTION

Certain embodiments disclosed herein provide a radiant cooling system that includes an enclosure including a first wall that is, at least partially, transmissive of infrared radiation, a cooling element disposed in the enclosure, and a cooling device coupled to the cooling element. The enclosure can be a vacuum chamber. Alternatively, the enclosure can enclose a gas having a molecular weight above 100 grams per mole. One gas having a molecular weight above 100 grams per mole that can be enclosed in the enclosure is xenon.

In certain embodiments, the enclosure includes a second wall that includes a low emissivity surface. In certain embodiments, the emissivity of the second wall is below 0.1. The low emissivity surface can be polished metal such as a metal selected from the group consisting of aluminum, copper, nickel, gold, and steel. In certain embodiments, insulation is disposed outside the enclosure proximate to the second wall.

The cooling element can be supported in the enclosure by a support element that includes a material having a thermal conductivity of less than 1.0 W/M K. For example, the material having a thermal conductivity of less than 1.0 W/M K can be plastic. The plastic can be polytetrafluoroethylene (also known as Teflon™) which has a thermal conductivity of 0.25 W/M K, polyvinyl chloride (also known as PVC) with a thermal conductivity of 0.19 W/M K, or low density polyethylene with a thermal conductivity of 0.33 W/M K.

In certain embodiments, the first wall of the enclosure has a convex external surface. For example the first wall can be dome shaped.

In certain embodiments, the cooling device that is coupled to the cooling element includes at least a portion of a refrigeration system.

In certain embodiments, the first wall of the enclosure includes chalcogenide glass which may be coated with an antireflection coating. An antireflection coating can also be used in cases where the first wall of the enclosure is made from a different material. The first wall of the enclosure can also include sapphire.

In certain embodiments, the cooling element comprises an evaporator of a refrigeration system and the cooling device comprises a compressor and a condenser of a refrigeration system.

In certain embodiments, heat from the condenser is directed to an outer surface of the system to raise a temperature of the outer surface above a dew point.

In certain embodiments, the enclosure is shaped as a cylinder including a side wall including a low emissivity surface, and the first wall defines a base of the cylinder.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXAMPLE EMBODIMENTS

Figure 1:
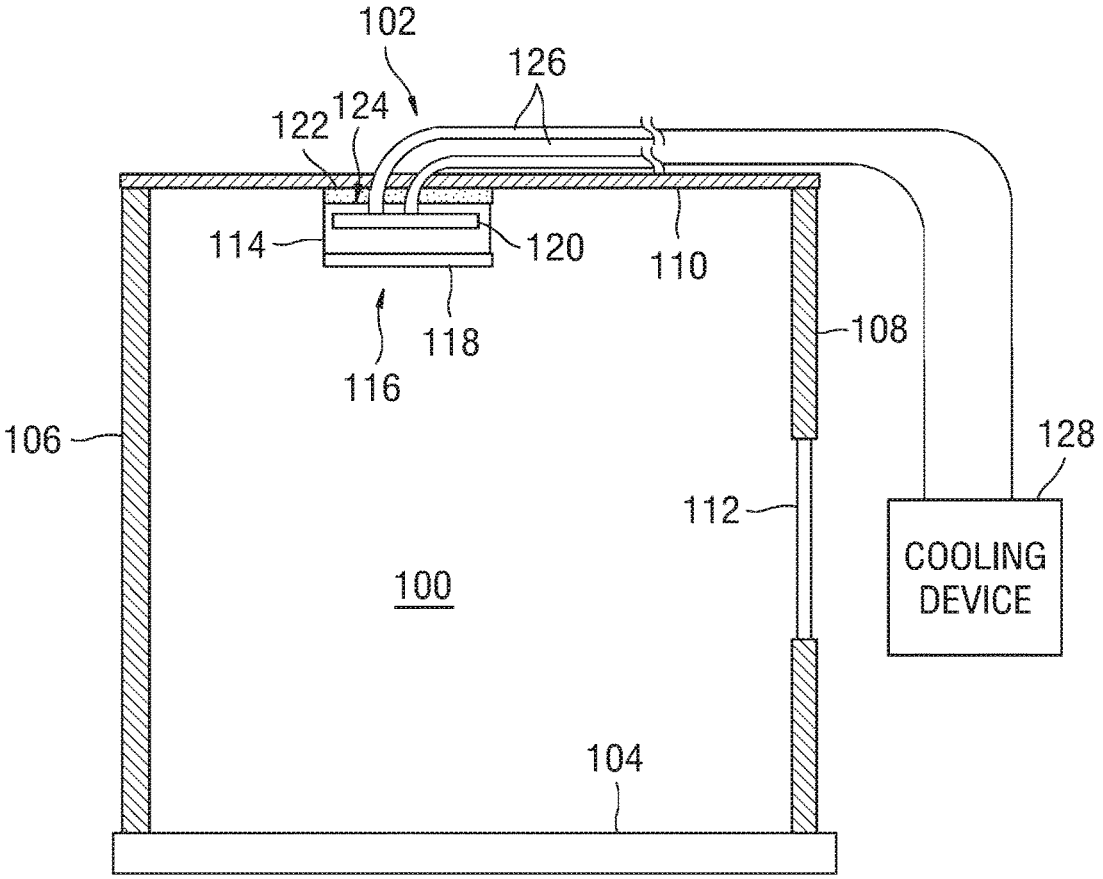
FIG. 1 is a schematic representation of a building room equipped with a radiant cooling system.

Referring now to the drawings, wherein like reference numerals designate identical or corresponding parts throughout the several views.

FIG. 1 is a schematic representation of a building room 100 equipped with a radiant cooling system 102. The building room 100 comprises a floor 104, a first wall 106, a second wall 108, and a ceiling 110. A window 112 is included in the second wall 108. A cooling radiator 114 is positioned proximate and below the ceiling 110. The cooling radiator 114 includes an enclosure 116 that is partially defined by a bottom wall 118 that is at least partially transmissive of a thermal radiation emitted by the floor 104, walls 106, 108 and ceiling 110 and objects (not shown) and persons (not shown) that are located in the building room.

Materials used to make the bottom wall 118 which is at least partially transmissive of thermal radiation may be fused silica, sapphire, germanium, silicon or zinc sulfide. A cooling element 120 is located in the enclosure 116. Insulation 122 is provided between a backside 124 of the cooling radiator 114 and the ceiling 110. Insulation 122 may also be provided on all sides besides the bottom wall 118. The cooling element 120 is connected by two conduits 126 to a cooling device 128. In one embodiment that is discussed in more detail below with reference to FIG. 4, the cooling element 120 includes an evaporator of a refrigeration system and the cooling device 128 includes additional components of the refrigeration system and the two conduits 126 serve to supply and return refrigerant to and from the cooling element 120. Alternatively, the cooling element 120 can be a different type of heat exchanger. A temperature sensor (not shown in FIG. 1) can be included in the cooling radiator 114.

In addition to use inside a building, the cooling radiator described herein can also be used to form a display for cold/frozen items as in the cold displays for the supermarkets or be used at outdoor areas where air is not contained. Examples of such areas are large stadiums, religious sites or open markets. Moreover, the cooling radiator may be used to cool food items in a vacuum.

Figure 2:
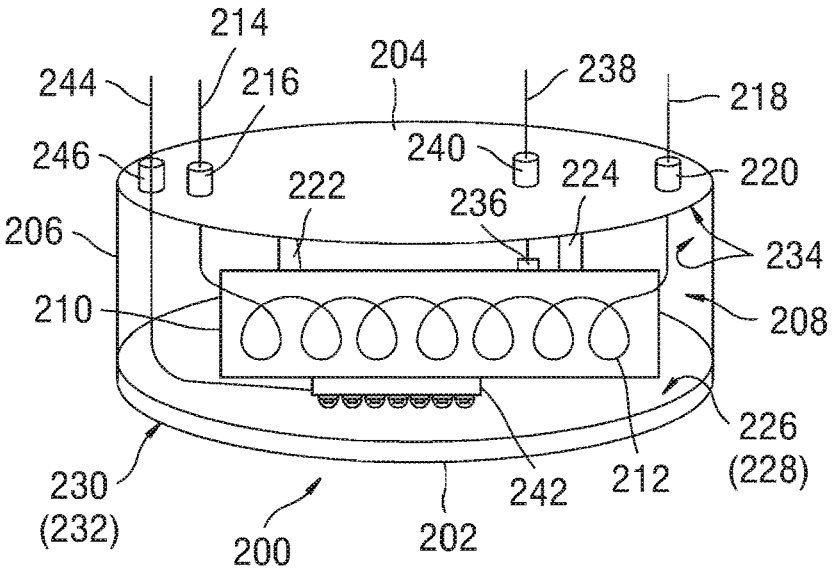
FIG. 2 is a schematic, isometric view of a cooling radiator according to a first embodiment of the disclosure.

FIG. 2 is a schematic isometric view of a cooling radiator 200 according to a first embodiment of the disclosure in which its interior components are made visible. The cooling radiator 200 can serve in the radiant cooling system 102 as the cooling radiator 114. The cooling radiator 200 has a cylindrical shape and includes a bottom planar wall 202, a top planar wall 204 and a cylindrical side wall 206 defining an enclosure 208. Alternatively, the cooling radiator 200 may also be box-shaped. The planar bottom wall 202 is made from a material that is at least partially transmissive of thermal radiation emitted from the building room 100 (FIG. 1). The bottom planar wall 202 can for example be made of chalcogenide glass or sapphire. Both chalcogenide glass and sapphire are partially transmissive of thermal radiation emitted by objects. The objects may be at room temperature which may be about 25° C. A cooling element 210 is positioned in the enclosure 208. The cooling element 210 can for example be an evaporator of a refrigeration system or a different type of heat exchanger. The cooling element 210 includes a conduit 212 that follows a convoluted path (e.g., coiled as shown or serpentine) through the cooling element 210. A heat exchange fluid (suitably a liquid, such as brine or a different type of refrigerant) through the conduit 212. The conduit 212 includes an inlet 214 that passes through a first feedthrough 216 in the top planar wall 204 and an outlet 218 that passes through a second feedthrough 220 in the top planar wall 204. The cooling element 210 is supported in the enclosure 208 by a first support 222 and a second support 224 which include (e.g., are made of) low thermal conductivity materials such as plastic. For example, the supports 222 and 224 may be made of materials having a thermal conductivity of less than 1.0 W/M K.

Figure 9:
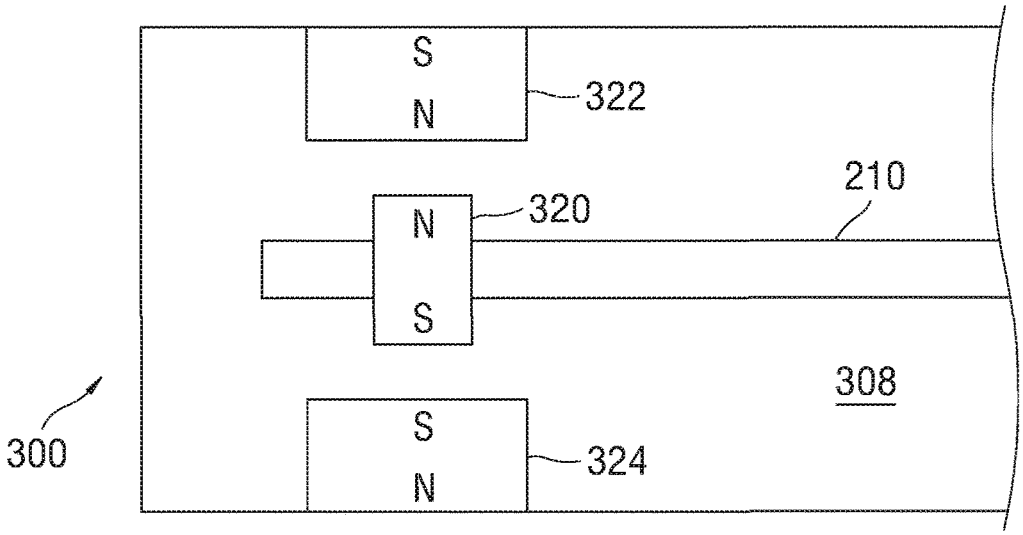
FIG. 9 is a side, cross-sectional view of a cooling radiator with supports using magnets.

Moreover, the supports could be made contactless by the use of magnets. Specifically, FIG. 9 shows a cooling radiator 300 which includes supports formed with magnets 322 and 324 to secure and stabilize a cooling element 210 which also includes a magnet 320. The magnet 320 and the cooling element 210 are secured by the magnets 322 and 324 in alignment therewith, as shown in FIG. 9, but other arrangements of these magnets are also possible.

A top surface 226 of the bottom planar wall 202 includes a first anti-reflection layer 228 and the bottom surface 230 of the bottom planar wall 202 includes a second anti-reflection layer 232. The anti-reflection layers 228, 232 can take the form of multilayer interference filters or surface relief layers which create a gradual transition in effective index of refraction. The cylindrical side wall 206 and the top planar wall 204 can have a low emissivity inside surface 234 to reduce radiative loss of the cooling element 210 through boundaries other than the bottom planar wall 202. For example, the inside surface 234 on the side wall 206 can have an emissivity below 0.1. The low emissivity inside surface 234 can, for example, include a polished metal such as aluminum, copper, nickel, gold or steel. Alternatively, a roughened surface with a higher emissivity may be used. The enclosure 208 can be vacuum chamber which is evacuated to form a hard or soft vacuum. Evacuating the enclosure 208 serves to eliminate (or reduce in certain cases of partial evacuation) convective and conductive heat transport between the walls 202, 204, 206 of the cooling radiator and the cooling element 210. Alternatively, the enclosure 208 can be filled with a high molecular weight and hence low thermal conductivity gas such as xenon, krypton, carbon dioxide or argon. For example, the gas may have a molecular weight above 100 grams per mole. A temperature sensor 236 is located on the cooling element 210. Lead wires 238 from the temperature sensors 236 pass through a third feed through 240 in the top planar wall 204 of the cooling radiator 200. A light emitting diode (LED) light engine 242 is positioned on the cooling element 210 in order to provide lighting in addition to cooling. Such a configuration may be desirable in certain applications and results in effective use of limited available surface or space. The cooling element 210 also helps to cool the LED light engine 242. Power supply wires 244 extend from the LED light engine 242 through a fourth feedthrough 246 in the top planar wall 204. The bottom planar wall 202 is at least partially transmissive of light emitted by the LED light engine 242. Sapphire is substantially transmissive of visible light and chalcogenide glass is partially transmissive of visible light which allows at least a portion of light generated by the LED light engine to pass through the bottom planar wall 202 and provide illumination in the building room 100.

In operation, heat radiated by the building room 100 or objects (not shown) or people (not shown) that are present in the building room 100, will pass through the bottom planar wall 202 of the cooling radiator 200 and be absorbed by the cooling element 210 which is maintained at a temperature below a temperature of the building room 100 (e.g., below room temperature). To the extent that the bottom planar wall 202 is partially transmissive of both thermal radiation that is emitted from the building room 100 and thermal radiation that is emitted by the cooling element 210, some radiative heat transfer occurs between the bottom planar wall 202 and both the building room 100 and the cooling element 210. Additionally, the bottom planar wall 202 is thermally coupled to the building room 100 through conductive and convective heat transport. Due to the radiative, conductive, and convective thermal coupling to the bottom planar wall 202, the bottom planar wall 202 will operate at a temperature that is between the temperature of the building room 100 (and its contents) and the temperature of the cooling element 210. The cooling element 210 can be operated at a temperature below the dew point within the building room 100 without causing condensation on the cooling element 200 because the enclosure 208 is either (at least partially) evacuated or is filled with a low thermal conductivity gas such as xenon. The above described design which avoids condensation on the cooling element 210 allows the size of the cooling element 210 to be reduced while maintaining cooling power by lowering the operating temperature of the cooling element 210. A reduced size cooling element 210 can sustain the same cooling power if its temperature is reduced. Reducing the size of the cooling element 210 and a proportional reduction in the overall size of the cooling radiator 200 makes the cooling radiator 200 less obtrusive and more presentable to building occupants.

Figure 3:
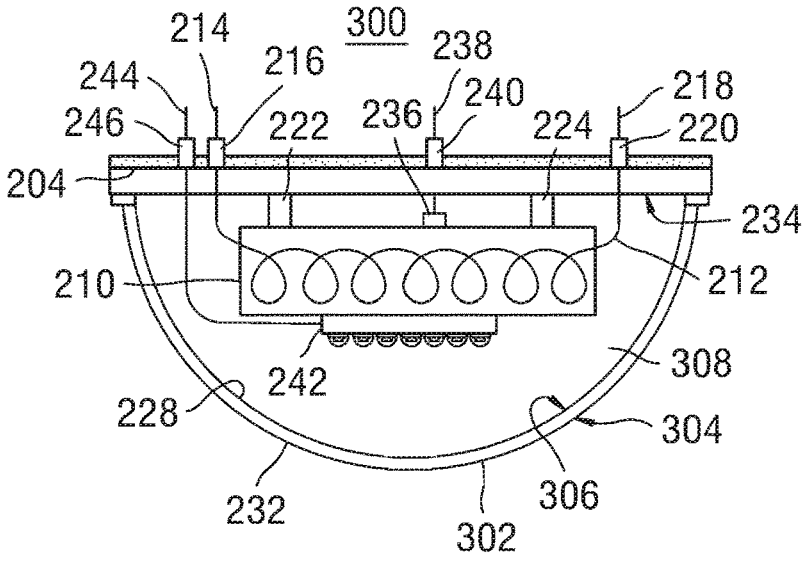
FIG. 3 is a schematic, side view of a cooling radiator according to a second embodiment of the disclosure.

FIG. 3 is a schematic side view of a cooling radiator 300 according to a second embodiment of the disclosure in which its interior components are made visible. The cooling radiator 300 shown in FIG. 3 has many components in common with the cooling radiator 200 shown in FIG. 2 as indicated by common reference numerals. The description of those common elements will not be repeated and reference is made to description of FIG. 2 herein above for a description of those common elements. In lieu of the cylindrical side wall 206 and the bottom planar wall 202, the cooling radiator 300 shown in FIG. 3 includes a lower dome 302 with an outward facing convex surface 304 and an inward facing concave surface 306. The lower dome 302 is positioned in contact with the top planar wall 204 forming an enclosure 308. The dome shape of the lower dome 302 is well suited to resisting atmospheric pressure forces on the outward facing convex surface 304 when the enclosure 308 is evacuated to form a vacuum. As in the case of the cooling radiator 300, the enclosure 308 can alternatively be filled with a high molecular weight, low thermal conductivity gas such as xenon. The lower dome 302 can for example be made of chalcogenide glass or sapphire. In the case of the cooling radiator 300, the first anti-reflection layer 228 is formed on the inward facing concave surface 306 and the second anti-reflection layer 232 is formed on the outward facing convex surface 304.

Figure 4:
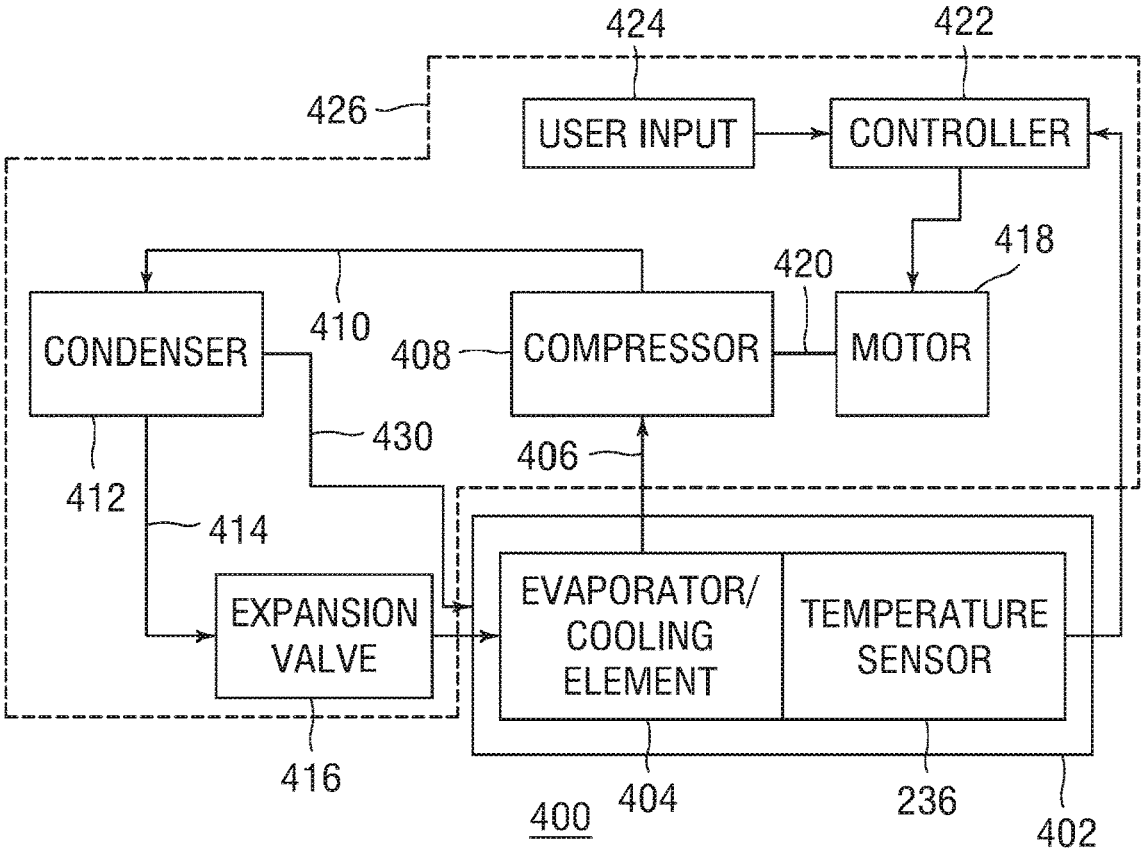
FIG. 4 is a schematic of a refrigeration system that is included in the radiant cooling system shown in FIG. 1 according to an embodiment of the disclosure.

FIG. 4 is a schematic of a refrigeration system 400 that is included in the radiant cooling system 102 shown in FIG. 1 according to an embodiment of the disclosure. Referring to FIG. 4, the refrigeration system 400 includes a cooling radiator 402 which may take the form of cooling radiator 114, cooling radiator 200 or cooling radiator 300. The cooling radiator 402 includes a cooling element 404 which in the system 400 is an evaporator and is referred to herein below as the cooling element/evaporator 404. The temperature sensor 236 is included in the cooling radiator 402 and is thermally coupled to the cooling element/evaporator 404. A refrigerant (not shown) passes from the cooling element/evaporator 404 through a first fluid conduit 406 to a compressor 408. The refrigerant is compressed by the compressor 408 and passed through a second fluid conduit 410 to a condenser 412 which dissipates heat from the compressed refrigerant to an ambient environment outside the building room 100. The heat 430 dissipated from the condenser 412 can be circulated to heat one or more external surfaces of the cooling radiator to a predetermined temperature slightly above the dew point to prevent formation of condensation on these surfaces. From the condenser 412, the refrigerant passes through a third conduit 414 and an expansion valve 416 which leads into the cooling element/evaporator 404. A motor 418 is drivingly coupled to the compressor 408 by a shaft 420. A controller 422 is coupled to the temperature sensor 236, the motor 416 and a user input 424. The controller 422 activates the motor 418 in response to the temperature sensor 236 and the user input 424 in order to maintain the temperature sensor 236 reading below a set point. Portions of the refrigeration system 400 that are outside the cooling radiator 402 are enclosed in a dashed polygon 426. Alternatively, the expansion valve 416, compressor 408, motor, controller 422 and user input 424 are included in the cooling radiator 402.

Figure 5:
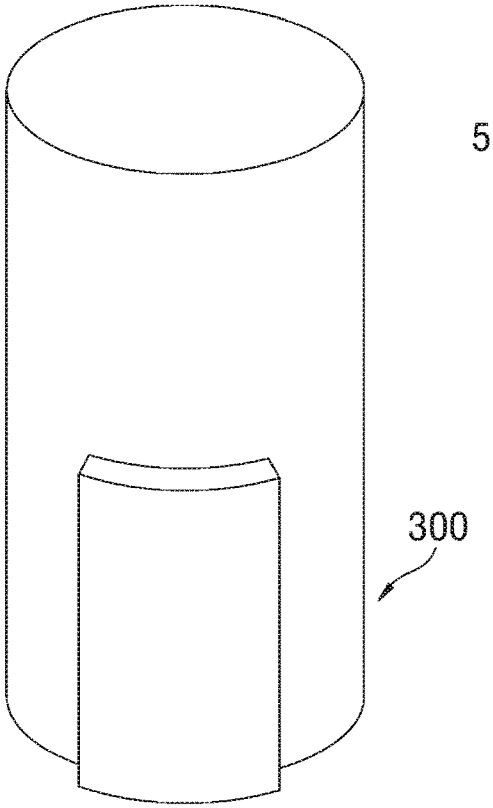
FIG. 5 is a perspective view of a cooling radiator according to a third embodiment of the disclosure.
Figure 6:
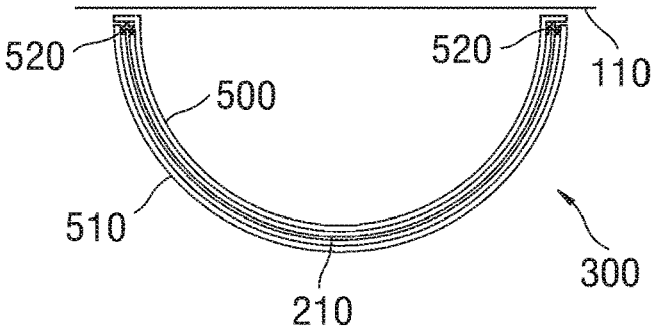
FIG. 6 is a top, cross-sectional view of the cooling radiator in FIG. 5.

FIGS. 5-6 illustrate a third embodiment of the cooling radiator 300 that is shaped as a curved plate. In this embodiment, the cooling radiator 300 may be mounted to surround or abut a cylindrical column (FIG. 5) or may be mounted on the ceiling 110 (FIG. 6). FIG. 6 shows a cross-sectional view of the cooling radiator 300 which has a curved plate or arch configuration and includes a thermal insulator 500, an infrared transparent cover 510, insulated supports 520, and a cooling element 210 located in a vacuum interior of the cooling radiator 300. While the embodiment in FIG. 6 has a semi-circular cross-section, the cooling radiator 300 may be a segmental arch that extends around less than 180 degrees (FIG. 5).

Figure 7:
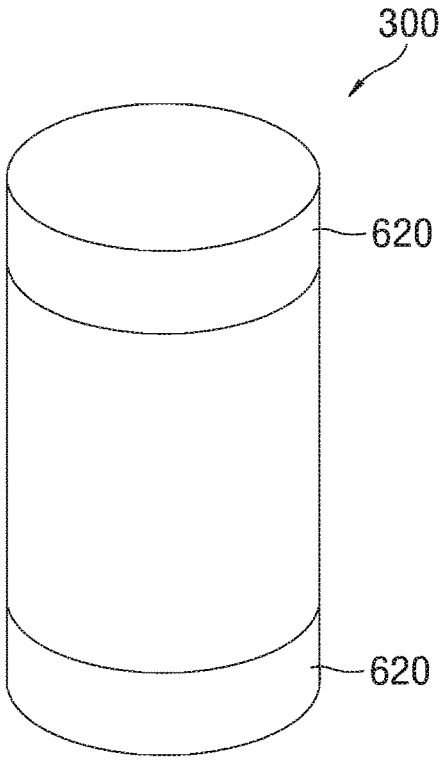
FIG. 7 is a perspective view of a cooling radiator according to a fourth embodiment of the disclosure.
Figure 8:
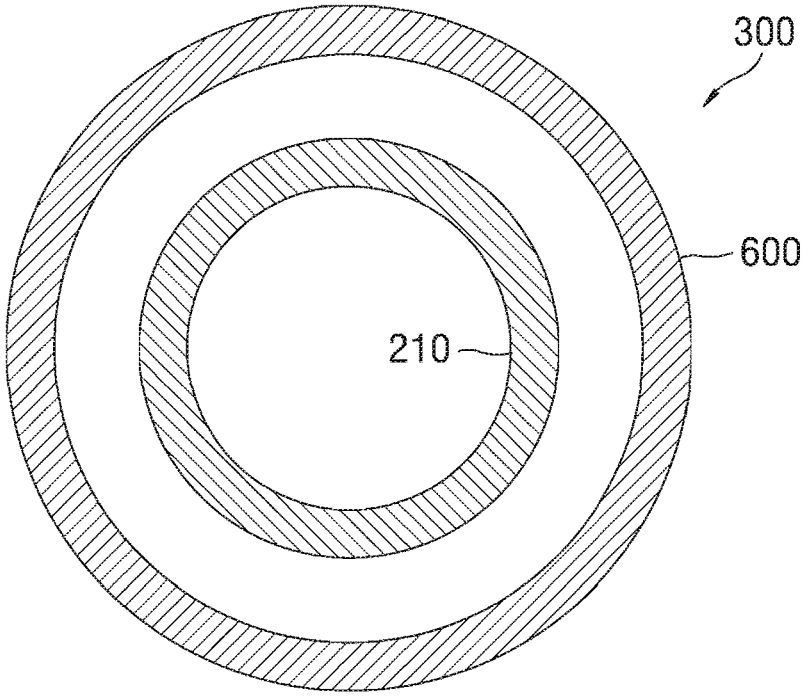
FIG. 8 is a top, cross-sectional view of the cooling radiator in FIG. 7.

FIGS. 7-8 illustrate a fourth embodiment of the cooling radiator 300 that is shaped as a cylinder with circular bases. In this embodiment, the cooling radiator 300 includes insulator supports 620 at the top and bottom of the cooling radiator 300. The cooling radiator 300 may be defined by an infrared transparent layer 600 with a tubular shape and may include in the interior thereof a tubular cooling element 210.

The third and fourth embodiments discussed above may be placed near the floor of areas frequented by passersby and may be dimensioned to provide cooling to regions in proximity thereof.

Obviously, numerous modifications and variations of the present invention are possible in light of the above teachings. It is therefore to be understood that within the scope of the appended claims, the invention may be practiced otherwise than as specifically described herein.

What is claimed is:

1. A radiant cooling system comprising:

an enclosure including:

a bottom wall that is at least partially transmissive of infrared radiation, and a top wall having an inside surface with an emissivity below 0.1;

a cooling element disposed inside the enclosure, between the bottom wall and the top wall of the enclosure;

a cooling device coupled to the cooling element, the cooling device being outside the enclosure;

insulation disposed outside the enclosure adjacent to the top wall and a ceiling of a room that houses the enclosure; and a light engine disposed on a bottom side of the cooling element, wherein the enclosure is at least partially transmissive of the infrared radiation from an outer side of the bottom wall to an inner side of the of the bottom wall, wherein the enclosure is a vacuum chamber, wherein the cooling element is operational at a temperature below a dew point within the room that houses the enclosure, and wherein the top wall of the enclosure is mountable to the ceiling of the room such that the insulation, which is disposed outside of the enclosure and adjacent to the top wall of the enclosure, is in direct contact with the ceiling and such that output of the light engine is directed away from the ceiling of the room.

2. The radiant cooling system according to claim 1, wherein the inside surface of the top wall includes polished metal.

3. The radiant cooling system according to claim 1, wherein the inside surface of the top wall includes at least one of aluminum, copper, nickel, gold, and steel.

4. The radiant cooling system according to claim 1, further comprising a support configured to support the cooling element in the enclosure, wherein the support includes a material having a thermal conductivity of less than 1.0 W/M K.

5. The radiant cooling system according to claim 4, where the material includes one of polytetrafluoroethylene, polyvinyl chloride, and low density polyethylene (LDPE).

6. The radiant cooling system according to claim 4, where the support provides non-contact magnetic support.

7. The radiant cooling system according to claim 1, wherein the bottom wall has a convex external surface as the outer side thereof.

8. The radiant cooling system according to claim 1, wherein the cooling device includes at least a portion of a refrigeration system.

9. The radiant cooling system according to claim 8, wherein the cooling element includes an evaporator of the refrigeration system and the at least portion of the refrigeration system includes a compressor coupled to a condenser which is coupled to an expansion valve which is coupled to the evaporator.

10. The radiant cooling system according to claim 9, wherein heat from the condenser is directed to an outer surface of the radiant cooling system to raise a temperature of the outer surface above the dew point.

11. The radiant cooling system according to claim 1, wherein the first wall includes an antireflection coating.

12. The radiant cooling system according to claim 11, wherein the bottom wall includes chalcogenide glass.

13. The radiant cooling system according to claim 11, wherein the bottom wall includes one of sapphire, quartz, germanium, silicon, and zinc sulfide.

14. The radiant cooling system according to claim 1, wherein the enclosure is shaped as a cylinder including a side wall including a surface with an emissivity less than the bottom wall, and the bottom wall defines a base of the cylinder.

* * * * *